US009714573B2

(12) United States Patent
Marsh et al.

(10) Patent No.: US 9,714,573 B2
(45) Date of Patent: Jul. 25, 2017

(54) ROTOR MECHANISM

(71) Applicant: Rotomotor Limited, Fettercairn (GB)

(72) Inventors: Jonathan Roy Graham Marsh, Fettercairn (GB); Victor Darievich Svet, Fettercairn (GB); Natalia Nikolaevna Komissarova, Fettercairn (GB)

(73) Assignee: ROTOMOTOR LIMITED (GB)

( * ) Notice: Subject to any disclaimer, the term of this patent is extended or adjusted under 35 U.S.C. 154(b) by 439 days.

(21) Appl. No.: 14/380,721

(22) PCT Filed: Mar. 4, 2013

(86) PCT No.: PCT/GB2013/050527

§ 371 (c)(1),
(2) Date: Aug. 24, 2014

(87) PCT Pub. No.: WO2013/132237

PCT Pub. Date: Sep. 12, 2013

(65) Prior Publication Data

US 2015/0010413 A1 Jan. 8, 2015

(30) Foreign Application Priority Data

Mar. 8, 2012 (GB) ..... 1204111.7

(51) Int. Cl.
*F04C 3/02* (2006.01)
*F04C 3/04* (2006.01)
(Continued)

(52) U.S. Cl.
CPC ..... *F01C 17/00* (2013.01); *F01C 3/02* (2013.01); *F01C 3/025* (2013.01); *F01C 9/005* (2013.01);
(Continued)

(58) Field of Classification Search
CPC .. F01C 3/02; F01C 9/005; F01C 20/04; F01C 1/28; F01C 3/06; F01C 3/025; F04C 3/02;
(Continued)

(56) References Cited

U.S. PATENT DOCUMENTS

| | | | | |
|---|---|---|---|---|
| 4,979,882 | A | 12/1990 | Wipf | |
| 7,625,193 | B2 * | 12/2009 | Chadwick | F01C 1/28 123/218 |
| 2006/0210419 | A1 | 9/2006 | Chadwick, II | |

FOREIGN PATENT DOCUMENTS

| | | | |
|---|---|---|---|
| DE | 19738132 | A1 | 9/1999 |
| EP | 1849958 | A1 | 10/2007 |
| SU | 470190 | * | 1/1975 |

* cited by examiner

*Primary Examiner* — Peter J Bertheaud
(74) *Attorney, Agent, or Firm* — Law Office of Jesse D. Lambert, LLC

(57) ABSTRACT

A rotor mechanism for use in moving fluid. The rotor mechanism has six rotor units spherically arranged, with at least one rotor unit including a port through it's body. Each rotor has the form of a truncated cone with two symmetric spiral recesses provided on the lateral surface of the rotor which acts to cooperate with the adjacent rotors. Rotation of at least one rotor unit causes rotation of adjacent rotor units which thereby moves fluid without compression between the outside of the mechanism and the port via a central substantially spherical free space cavity formed by the cooperation of inner surfaces of the rotor units. The rotor mechanism is fully submersible.

19 Claims, 12 Drawing Sheets

(51) Int. Cl.

| | |
|---|---|
| ***F01C 3/02*** | (2006.01) |
| ***F01C 17/00*** | (2006.01) |
| ***F01C 9/00*** | (2006.01) |
| ***F01C 21/08*** | (2006.01) |
| ***F04B 35/04*** | (2006.01) |

(52) U.S. Cl.
CPC ..... *F01C 21/08* (2013.01); *F04B 35/04* (2013.01); *F04C 3/02* (2013.01); *F04C 3/04* (2013.01)

(58) Field of Classification Search
CPC ..... F04C 3/04; F04C 3/06; F04C 3/08; F04C 3/085
USPC ..... 417/410.4; 418/68, 196
See application file for complete search history.

PRIOR ART

PRIOR ART

PRIOR ART

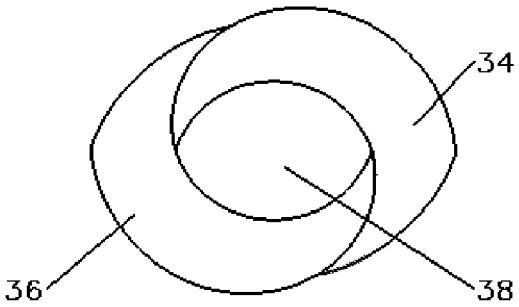
FIGURE 14A
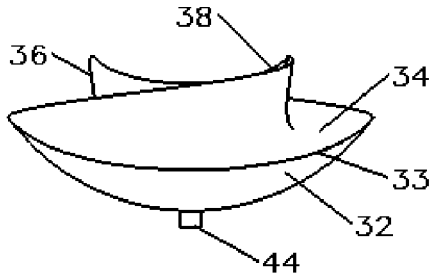
FIGURE 14B
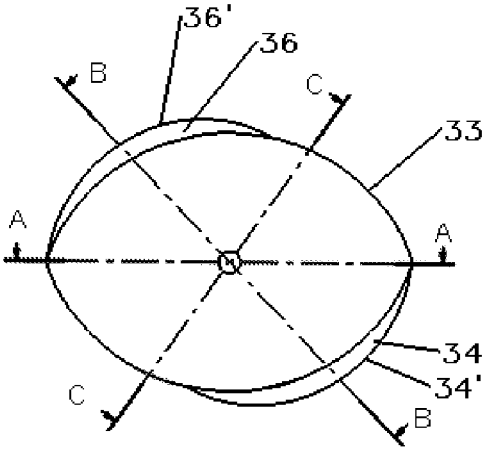
FIGURE 14C
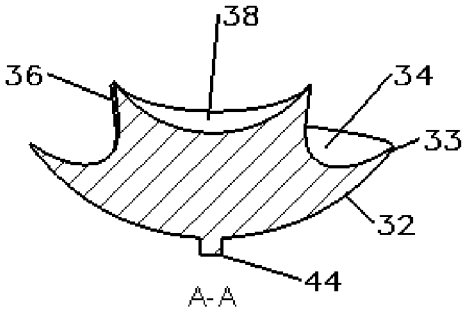
FIGURE 14D
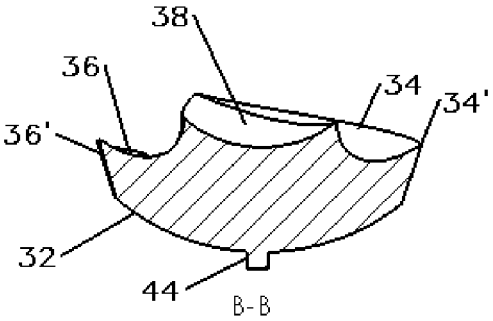
FIGURE 14E
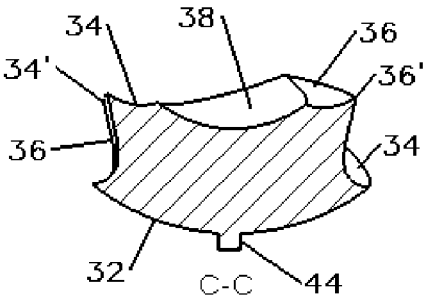
FIGURE 14F
FIGURE 14.

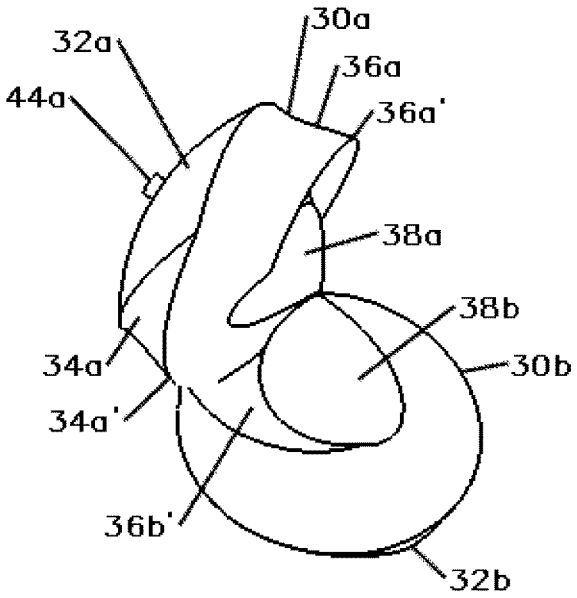
FIGURE 15A
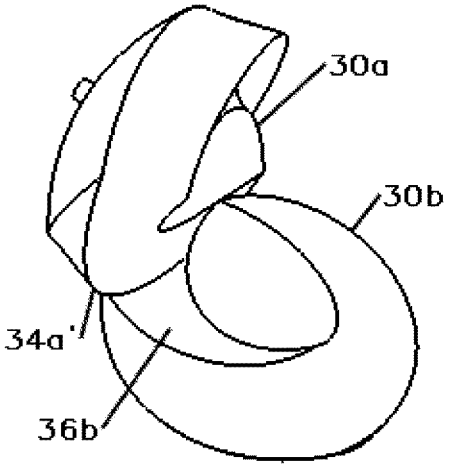
FIGURE 15B
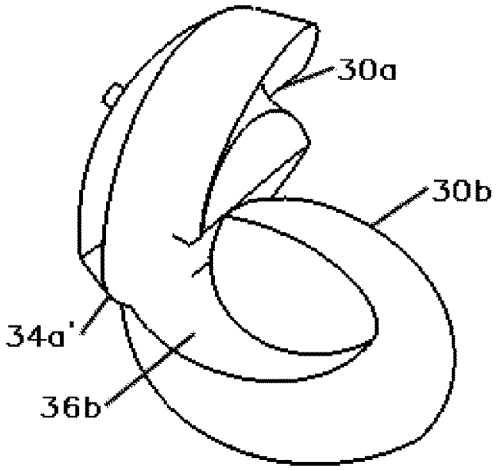
FIGURE 15C
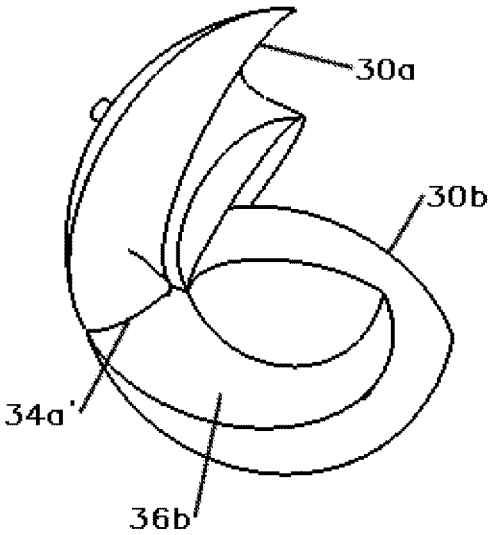
FIGURE 15D
FIGURE 15.

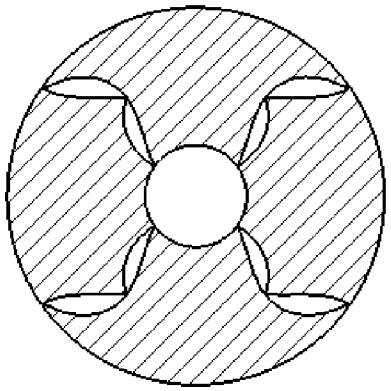
FIGURE 16A
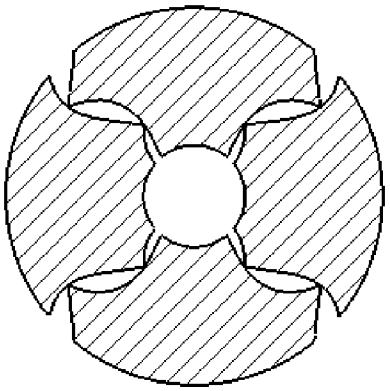
FIGURE 16B
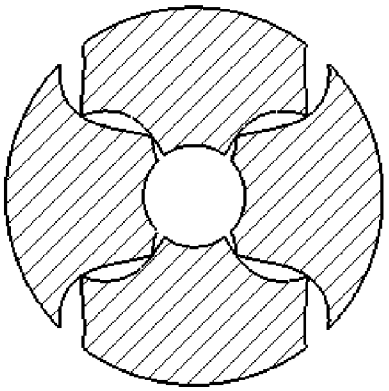
FIGURE 16C
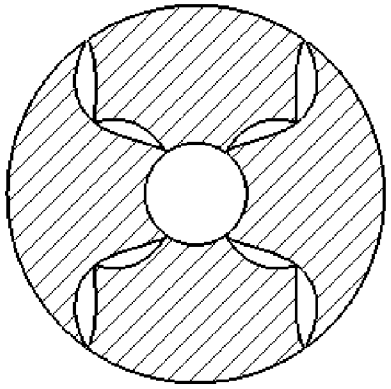
FIGURE 16D
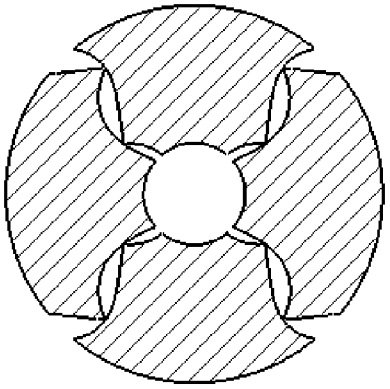
FIGURE 16E
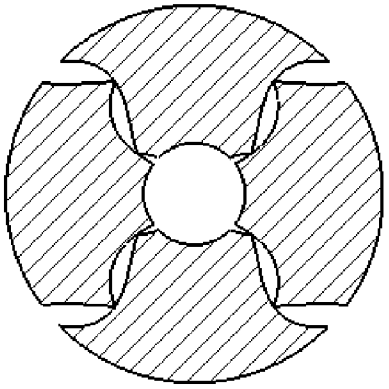
FIGURE 16F
FIGURE 16.

ROTOR MECHANISM

The present invention relates to a rotor mechanism, in particular the present invention relates to a fully submersible rotor mechanism for moving fluid.

BACKGROUND OF THE INVENTION

Pumps traditionally fall into two major groups: rotor-dynamic pumps and positive displacement pumps. Their names describe the method used by the pump to move fluid. Rotor-dynamic pumps are based on bladed impellers which rotate within the fluid to impart a tangential acceleration to the fluid and a consequential increase in the energy of the fluid. The purpose of rotor-dynamic pumps is to convert this kinetic energy into pressure energy in the associated piping system. A positive displacement pump causes a liquid or gas to move by trapping a fixed amount of fluid or gas and then forcing (displacing) that trapped volume into the discharge pipe. In both these types of pumps the fluid motion can be considered as moving in two dimensions along a plane.

No matter what type of pump is used, they all have one common design feature: the mobile part (rotor or turbine) is located in a rugged sealed case (stator). This design primarily increases the weight and size of the pump. The pump also requires many different parts such as bushings, gears seals etc. Given that a pump with high productivity Q (liter/min) requires a very high rotation speed (RPM) these additional mechanical parts result in a variety of different negative effects in terms of vibration, friction losses, noise, large power consumption and pulsation of the fluid stream which reduce the reliability of the pump.

A volumetric rotor machine has been developed for use in hydro mechanical engineering which does not require a waterproof case because the areas of high and low pressure are formed within the rotating units The rotor machine is formed of six rotors fixed in an axial direction on motionless, mutually perpendicular axes. Each rotor has the form of a truncated cone with two symmetric spiral recesses provided on the lateral surface of the rotor which acts to co-operate with the adjacent rotors. Channels of low pressure are formed in the mechanism by the periodic creation of a working chamber from the greater end faces of each of the rotors and channels of high pressure, by creating a working chamber from the small end faces of each of the rotors wherein the central part of the machine and the respective end faces form a cavity of high pressure and in one or more axes of the rotors, axial chambers are created. The mechanism is operated by being submerged in liquid and the surrounding liquid enters the mechanism from all sides in contrast to conventional pumps which as a rule, have a single inlet or suction port.

This volumetric machine was invented by A. V. Vagin in 1972 and was registered in the State Register of Inventions of the U.S.S.R. on Jan. 14 1975, as Invention Certificate 470190, now published as SU470190. As the original document is in Russian, we provide a translation of the description herein.

A general view of the volumetric rotor machine is shown in FIG. 1 with a view of one rotor shown in FIG. 2. Sections of a rotor are shown in FIGS. 3 to 6. Planar sections of the device where the plane passes through the axes of the rotors on angle $\phi$ equals 0°, 45°, 90° and 135° respectively, are shown in FIGS. 7 to 10.

The volumetric rotor machine contains six identical rotors, 1-6 each having the form of a truncated cone with two spiral recesses formed on the lateral surface. The recesses are formed such that their minimums lie coaxially with a conic rotor surface with an angle $u_1$ at the top where $$u_1=\arccos\sqrt{2/3}=35°\ 15' \tag{1}$$

and the edges lie coaxially with a conic rotor surface with an angle $u_2$ at the top, where $$u_2=\arccos\sqrt{1/3}=54°\ 15' \tag{2}$$

wherein the tops of both conic surfaces coincide with the top of a rotor. The lateral surface of a rotor in a spherical system of coordinates (r, u, $\phi$) is described by the equations:

$$u=\arccos(t/\sqrt{3})$$

and $$\phi=\arcsin[(t^2+t-2)/\sqrt{2(3-t^2)}]+\phi_0(r)$$

$$\text{with } 1\le t\le\sqrt{2} \tag{3}$$

where $\phi_0(r)$ is any monotonous function defining a view of spiral deepening and edges on a lateral surface of a rotor.

In the equations (3) the dependence $\phi(u)$ is essential at r=constant and for the function $\phi(r)$ at u=constant, monotony is important only. In other words, the form of section of a rotor by spherical surface with the centre in its top is the key factor and a twisting of a rotor in a spiral around its axis at transition from one horizontal section to another, defined by the additive $\phi_0(r)$, should only be monotonous. The form of the face surfaces of the rotors is not essential.

Plane CC is the main axial plane of a rotor. Mutually perpendicular axes 7 of rotors are crossed at one point. The tops of all six rotors lie on a point of crossing of the semi-axes. Mutual orientation of rotors means that axial planes of rotors 1 and 2 pass through axes of rotors 3 and 4, the main axial planes of rotors 3 and 4 pass through axes of rotors 5 and 6 and the main axial planes of rotors 5 and 6 pass through axes of rotors 1 and 2.

Spiral rotors on lateral surfaces of rotors adjoin on the length to deepening on lateral surfaces of the next rotors so that periodic creation of working chambers inside the device form a cavity of high pressure 8 and in one or several axes of rotors, channels of high pressure the through channels of the working medium are executed and connected with the cavity 8 and the exhaust 9.

Channels of low pressure 10 are formed by periodic disclosing of working chambers from the side of the greater end faces of rotors.

The device possesses one internal rotary degree of freedom—turn of one of the rotors around the axis on any angle necessarily entails turn of the other rotors around of the axes on the same angle. At turn of rotors around the axes, the chamber inside the device remains closed and its volume periodically changes.

In an initial position, such as that shown in FIG. 7, the section of rotors 1 and 2 coincides with section A-A of a rotor on FIG. 3 and rotors 5 with section CC on FIG. 5. As angles $u_1$ and $u_2$ also supplement each other up to 90°, edges of rotors 1 and 2 lay in this section on minima of the deepening's of rotors 1 and 2. In position $\phi$=45° (see FIG. 8) the section of rotors 1 and 2 coincides with section D-D on FIG. 4. Edges of rotors 1 and 2 lay in the section of minima of deepening's of rotors 5 and 6 and edges of rotors 5 and 6 lay on minima of deepening's of rotors 1 and 2.

Positions $\phi$=90° (see FIG. 9) and $\phi$=135° (see FIG. 10) coincide with positions $\phi$=0° and $\phi$=45° if to look at the drawings having turned them by 90°. The period of recurrence of a picture is 180°.

Each quarter turn of the rotors in positions $\phi$=45°, 135°, 225°, 315° gives a spasmodic change of volume of the working chamber from V up to $V_{max}$. At one turn of the rotors in the chamber, the value of the volume which is forced or sucked away is equal to $$\Delta V=4(V_{max}-V_{min}) \quad (4)$$

The attitude of ΔV to total volume of design V is equal $$\Delta V/V\approx 0.5 \quad (5)$$

There are some major drawbacks in using this volumetric rotor machine. This design creates high pressure cavities between the internal (central cavity at end faces of rotors) and the external (outer faces of the rotors) spheres of the mechanism. The pressure zones generated create a systemic imbalance that drives fluid through the device creating a flow. As the device is configured, the gearing mechanism (the axles 7) is an integral part of the volume capture mechanism. This means that the device cannot retain pressure like other positive displacement pumps, by using seals in the contacted surfaces of the cavities. This limitation reduces the effectiveness of the design considerably as a large amount of pressure is lost through the mechanism and not imparted to the fluid in flow.

This is exacerbated by the fact that the gears 7 fill a major portion of the high pressure cavity 8. Cavity 8 is therefore not a free space cavity which would only contain fluid. Additionally, the high pressure cavity 8 is relatively small, as the radius of the inner surface 12 (see FIG. 5), is less than half the radius of the outer surface 14 of each rotor unit 1-6, restricting the volume of the now compressed fluid which can pass through the cavity 8 and out of the exhaust 9. Thus a further disadvantage of this prior art rotor mechanism is that it compresses the fluid which in turn increases the back pressure at any restrictions such as the exhaust 9.

Additionally, the device operates by being held stationary at the exhaust 9. Thus, the other five rotors can rotate about their axes 7, but the rotor containing the exhaust 9 must remain stationary as the exhaust line must be stationary. The arrangement is therefore limited to a single exhaust line. It has been found, in use, that the flow rate restrictions in the exhaust line increase back pressure through the mechanism resulting in the expulsion of fluids through the inlets which makes the entire mechanism inefficient.

The back pressure, coupled with the high pressure experienced in pulses through the mechanism also causes rapid wear and damage at the edges of the rotors.

DE19738132 to Jaitner describes a multi-element compression machine which has at least three elements rotating about fixed axles and with spiral interlocking surfaces which are out of contact to provide a minimum spacing. The elements rotate at a constant speed and generate new compression volumes which pass through the machine in a more laminar way than with conventional compression engines. No special seals are required for a high efficiency compression action.

Like Vagin, this machine also compresses the fluid which will therefore have the same disadvantages in back pressure.

U.S. Pat. No. 4,979,882 to the Wisconsin Alumni Research Foundation discloses a spherical rotary machine which may be embodied as a pump, internal combustion engine, compressor or similar other device includes an outer shell with a substantially spherical interior surface, an inner shell including a substantially spherical outer surface centered within the outer shell, and six rotary pistons located between the inner and outer shell. Each piston is rotatable about its own central axis, the six axes being orthogonally centered on the center of the machine. Each piston includes a top convex spherical surface conforming substantially in shape to and located adjacent to the spherical interior surface of the outer shell, a bottom concave spherical surface conforming substantially in shape to and located adjacent to the spherical outer surface of the inner shell, and an oval conical side surface which is substantially defined by lines which are substantially radial with respect to a point near the machine center. The oval side surface of any single piston at least nearly touches tangentially along generally radial lines the oval side surface of each of its four adjacent pistons so that any three pistons which are all adjacent to each other form a displacement chamber which varies in size as the pistons simultaneously rotate. Each piston is operably connected to a gear which is interconnected with the gears of the other pistons to regulate the relative positions of the pistons to ensure that all the pistons rotate with identical speed and direction with respect to the center of the machine. These gears may be located within or without the outer shell of the machine.

Again, like Vagin, this machine compresses the fluid and includes axles of the gearing mechanism which pass through and interrupt the high pressure cavity within the substantially spherical interior surface. In this way it has the same disadvantages as for Vagin. Additionally, there is no twist on any of the pistons, so the machine would not achieve movement of fluid from the outer surface through the exhaust as without the twist there is no means of fluid capture.

US 2006/0210419 to Searchmont LLC describes a rotary machine which can be either a pump or an internal combustion engine has a housing enclosing a plurality of rotor spindles lying on the surface of an imaginary cone for driving an output shaft positioned at the vertex of the imaginary cone. The spindles have a beveled gear on one end and engaging an output shaft and a conical bearing on the other end. Angled eccentric rotors are mounted to each spindle shaped to maintain tangential sliding contact with two adjacent rotors to form a compression or combustion chamber. A spherical version of a compressor or an engine uses a plurality of rotary pistons each of which is eccentrically mounted and forms a spherical segment. Each rotary piston is mounted for tangential sliding contact with at least two other rotary pistons to form a displacement chamber therebetween. The rotary pistons use a generally "tear drop" shape. A rotary pump has a housing having a manifold for distributing intake and exhaust air. The pump has a plurality of lobe shafts, each having an eccentrically mounted rotor attached thereto mounted in the housing to form a compression chamber in the middle of the rotor when the rotors are all in contact with each other during rotation.

Like the other prior art, this machine is designed to compress the fluid, as required of a combustion engine. The rotary pistons lack a twist angle and thus fluid capture is not achieved to move the fluid between an outer surface of the machine, to a central cavity and then via a port back to a position at the outer surface.

It is an object of the present invention to provide a rotor mechanism which obviates or mitigates at least some of the disadvantages of the prior art.

SUMMARY OF THE INVENTION

According to a first aspect of the present invention there is provided a rotor mechanism for use in moving fluid, the rotor mechanism comprising:

a plurality of rotor units spherically arranged to form a rotor mechanism body;

each rotor unit including an outer surface and an inner surface and at least one rotor unit having a first opening on the outer surface and a second opening on the inner surface such that an elongate aperture extends between the first and second openings to create a port through the rotor unit; and wherein rotation of at least one rotor unit causes rotation of adjacent rotor units which thereby moves fluid without compression between an outer surface of the body and the port via a central substantially spherical free space cavity formed by the cooperation of the inner surfaces of the rotor units.

In this way, a large uninterrupted free space cavity is formed in the centre of the rotor mechanism which is not impinged by a gearing mechanism. This allows for transfer of a larger volume of fluid which reduces the likelihood of back pressure and allows a seal to be created between the moving rotors so that pressure is maintained as would be expected in a positive displacement pump.

Preferably, the rotor mechanism body is supported in an external frame. In this way, there is no requirement for an internal gearing mechanism and axles are not required to be mounted through the rotors. This provides a highly compact design which can be of low weight and small dimensions.

More preferably, the frame comprises a plurality of arcs. In this way, the outer surface of the body is left unobstructed for the transfer of fluid. Preferably, the frame supports the body on a plurality of bearings. In this way, the rotor units can move independently of the frame.

Preferably, at least two rotor units have a port through the rotor unit. In this way, multiple exhaust ports can be present which increases the exit volume and thereby further reduces the possibility of back pressure.

Preferably, each rotor unit is operable to co-operate with adjacent rotor units such that during rotation plural channels are created in which fluid is carried in one direction between the outer surface of the mechanism body and the central free space cavity. The direction of travel will be dependent on the direction of rotation of the rotors. Preferably, each rotation fills the channel and seals each end thereof to create a temporary chamber. In this way, a plurality of ports is temporarily created at the outer surface of the body. The temporary ports may act as input or output ports depending on the direction of rotation of the rotor units.

Preferably, each rotor unit has at least two lateral surfaces which are arranged to provide the rotor unit with a truncated double helix form. In this way, the truncated double helix form of the lateral surfaces of the rotor units provides an arrangement to create the channels.

Preferably the rotor mechanism is provided with six rotor units. In this way, the rotor mechanism can be designed around the three axes model of the prior art. More preferably, each rotor unit comprises a conical screw rotor, having an axis at right angles to adjacent rotor units and which is twisted at an angle over a length of a truncated cone. The angle provides the rotation angle of the double helix form of lateral surfaces. Preferably, each rotor unit has the same dimensions. In this way, the length and angle can be used to determine the volume of fluid through the channels and in the central cavity with respect to the radius of the outer surface of the body.

Preferably a radius of the inner surface of a rotor unit is greater than half a radius of an outer surface of a rotor unit. In this way, the radius of the free space cavity is greater than half the radius of the outer body so that fluid is not compressed in entering the free space cavity or restricted on exiting the port.

Preferably, the radius of the outer body and the length and twist angle of the rotor units are selected to substantially eliminate any fluid compression through the rotor mechanism. In this way, the mechanism acts as a positive displacement pump in contrast to the prior art mechanism. Additionally, the rotor mechanism can pump up to around half the volume of the outer body on a single rotation of the rotor units. In this way, a high capacity low pressure pump is formed.

Preferably, the radius of the outer body, the length and twist angle of the rotor units and dimension of the ports are selected to substantially equalize the volume of fluid travelling through the rotor mechanism. In this way, hydraulic losses due to large volumetric discrepancies creating high pressures are eliminated.

Preferably, a spiral edge of each rotor making up the free space central cavity, has a coil of just equal to 180 degrees in order to completely isolate the central cavity from the environment. In this way, the rotor mechanism can be considered as 'not blown' as compared to known designs of turbine and centrifugal pumps which are blown or have permeability.

In an embodiment, a first rotor unit is held stationary and the remaining rotor units rotate synchronously around three mutually perpendicular axis which converge at a central point of the central cavity of the rotor mechanism. In this way the rotor mechanism can operate in the same fashion as the prior art volumetric rotor mechanism, but can have additional exhaust ports to more efficiently move the fluid through the mechanism. This can provide a spherical high capacity low pressure submersible pump. Such a pump finds use as a bilge pump for sea vessels.

Preferably the rotor mechanism is further provided with a drive unit which in use, acts upon one of said rotor units operable to rotate in order to actuate and drive the rotatable rotor units. The drive unit may be any motor arrangement as known to those skilled in the art. The mechanism can be operated at very low values of RPM and thus a small motor unit having its drive shaft connected to an axis of a rotor unit can be used in contrast to the large two stage hydraulic pump arrangements of the prior art.

Alternatively, the drive unit may operate in the rotor mechanism by means of an electromagnetically induced rotation. One or more rotor units may include windings in the rotor or around an axis thereof, coupled with a magnetic source of opposing pole, an induced rotational force can be delivered by electrical supply to the windings. In this way, a very compact spherical high capacity low pressure pump is formed as either an AC or DC motor.

Alternatively, a spherical generator can be formed in which rotation of the rotor units is carried out by an external force and electricity is generated by moving the windings across the magnetic field. In this embodiment, fluid (or any method of imparting rotation) is input through the port in a rotor unit and exits through the temporary ports on the outer surface. This provides a spherical high capacity low pressure electrical generator. More preferably, the application of a fluid through a port induces rotation of a rotor unit which thereby operates the rotor mechanism.

Advantageously, one or more rotor units may include windings on an axis thereof with a core located within the windings, which by the application of a fluid through a port causes rotation of the rotor unit and windings to induce electrical flow at each core to provide a spherical turbine.

BRIEF DESCRIPTION OF THE DRAWINGS

Embodiments of the present invention will now be described, by way of example only, with reference to the accompanying drawing of which:

FIGS. 14A to 14F are different views of an embodiment of a rotor of the rotor mechanism of the present invention;

FIGS. 15A to 15D are schematic diagrams of a section of an embodiment of a driving mechanism of the rotor mechanism of the present invention;

FIGS. 16A to 16F are graphical representations of fluid progression in a rotor mechanism according to a further embodiment of the invention;

DETAILED DESCRIPTION OF THE PRESENT INVENTION

Figure 1:
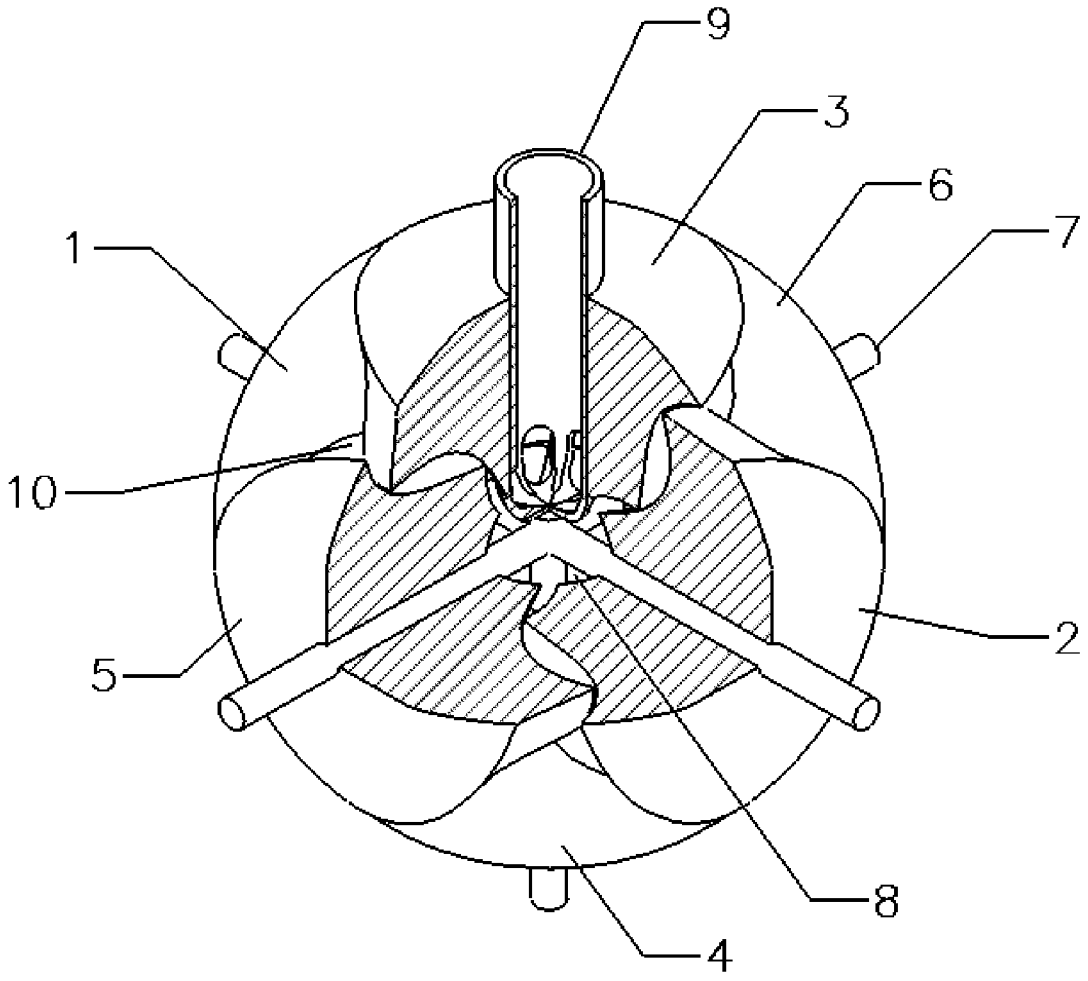
FIG. 1 is a schematic diagram of a known volumetric rotor mechanism.
Figure 2:
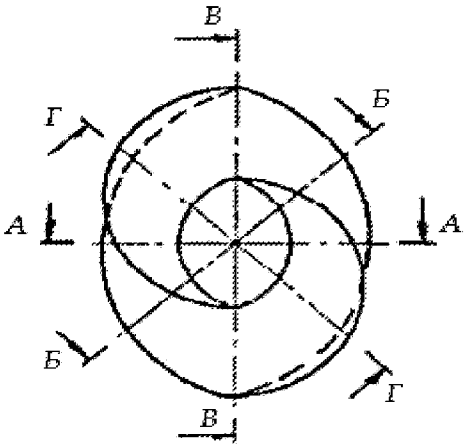
FIGS. 2 to 6 are cross sections of details of features of the volumetric rotor mechanism of FIG. 1.
Figure 3:
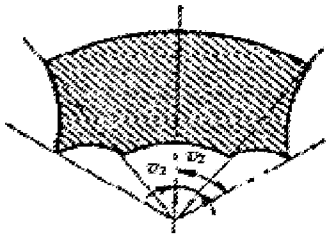
Figure 4:
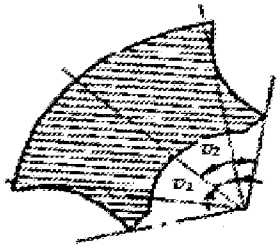
Figure 5:
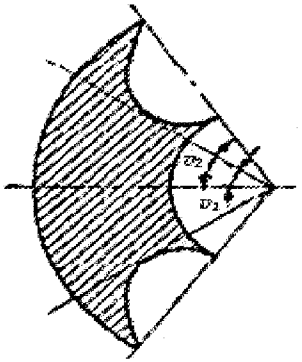
Figure 6:
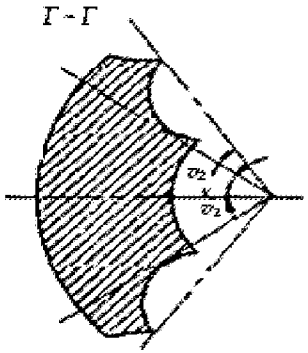
Figure 7:
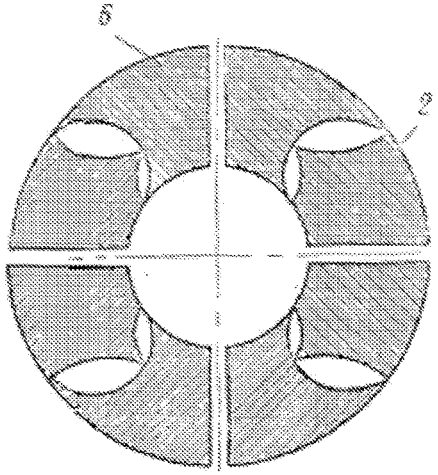
FIGS. 7 to 10 are cross sections of the volumetric rotor mechanism of FIG. 1 through different planes.
Figure 8:
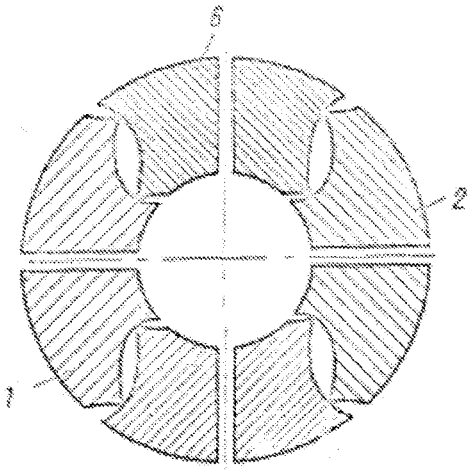
Figure 9:
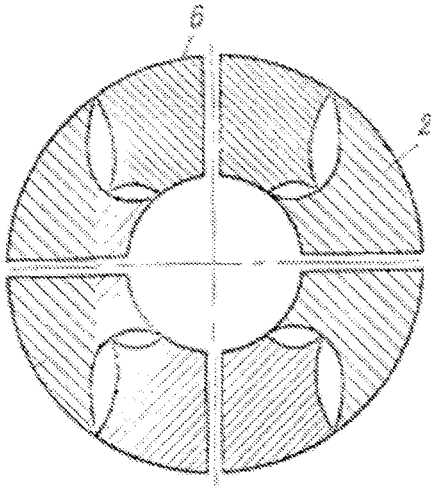
Figure 10:
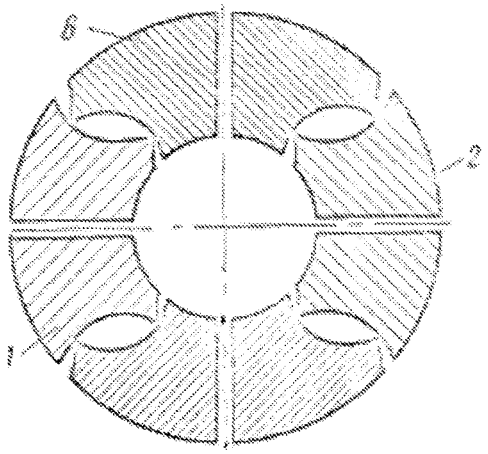
Figure 11:
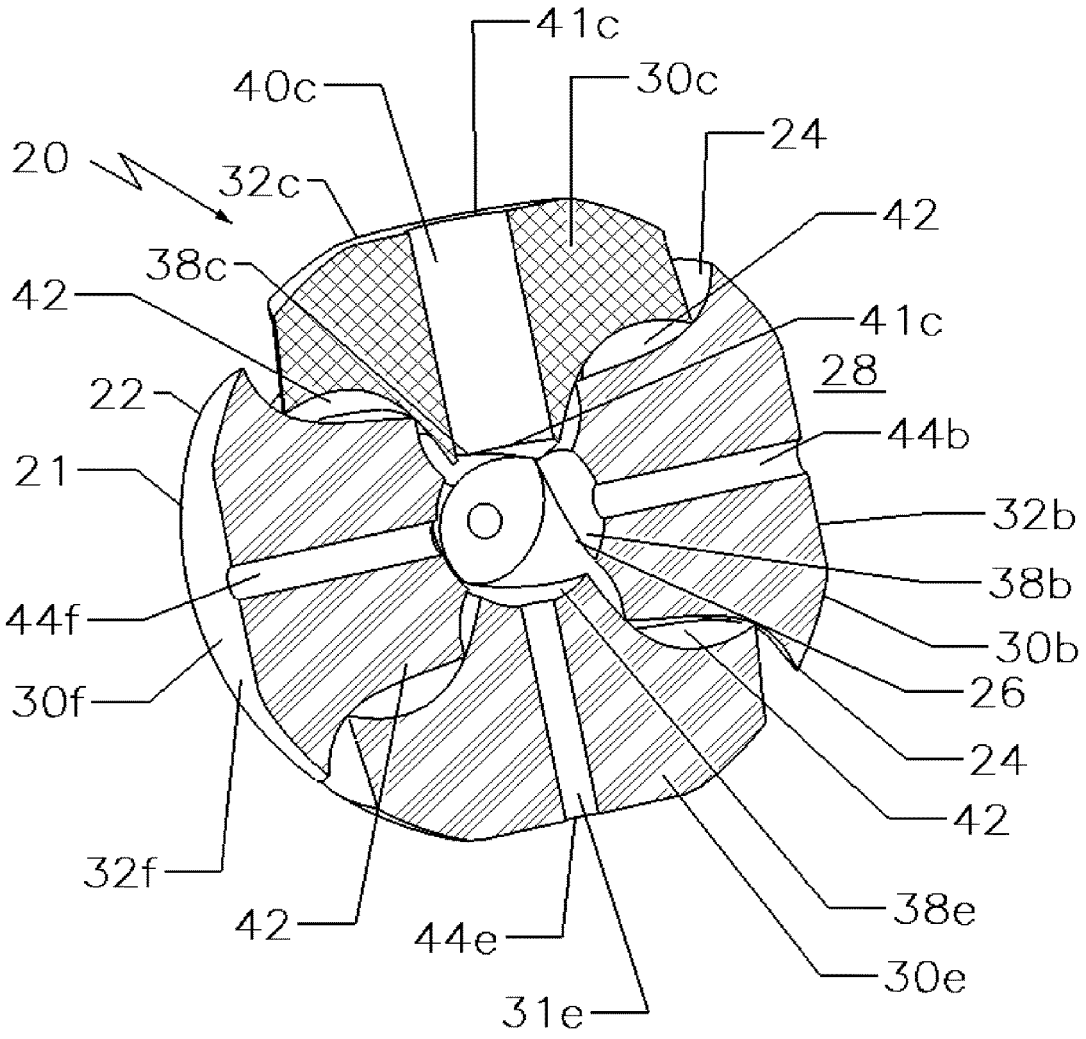
FIG. 11 is a cross-sectional view through a schematic illustration of a rotor mechanism according to a first embodiment of the present invention.

Reference is initially made to FIG. 11 of the drawings which shows a rotor mechanism, generally indicated by reference numeral 20, in cross-section exposing four of six rotor units 30*a*-30*f*, arranged spherically to form a rotor mechanism body 21, with each rotor unit 30 having an outer surface 32*a*-32*f* and inner surface 38*a*-38*f* respectively, and a port 40*c* providing an aperture 41*c* between the outer surface 32*c* and the inner surface 38*c* of a rotor unit 30*c*, leading to a free space cavity 26 in the centre of the rotor mechanism 20.

Figure 12:
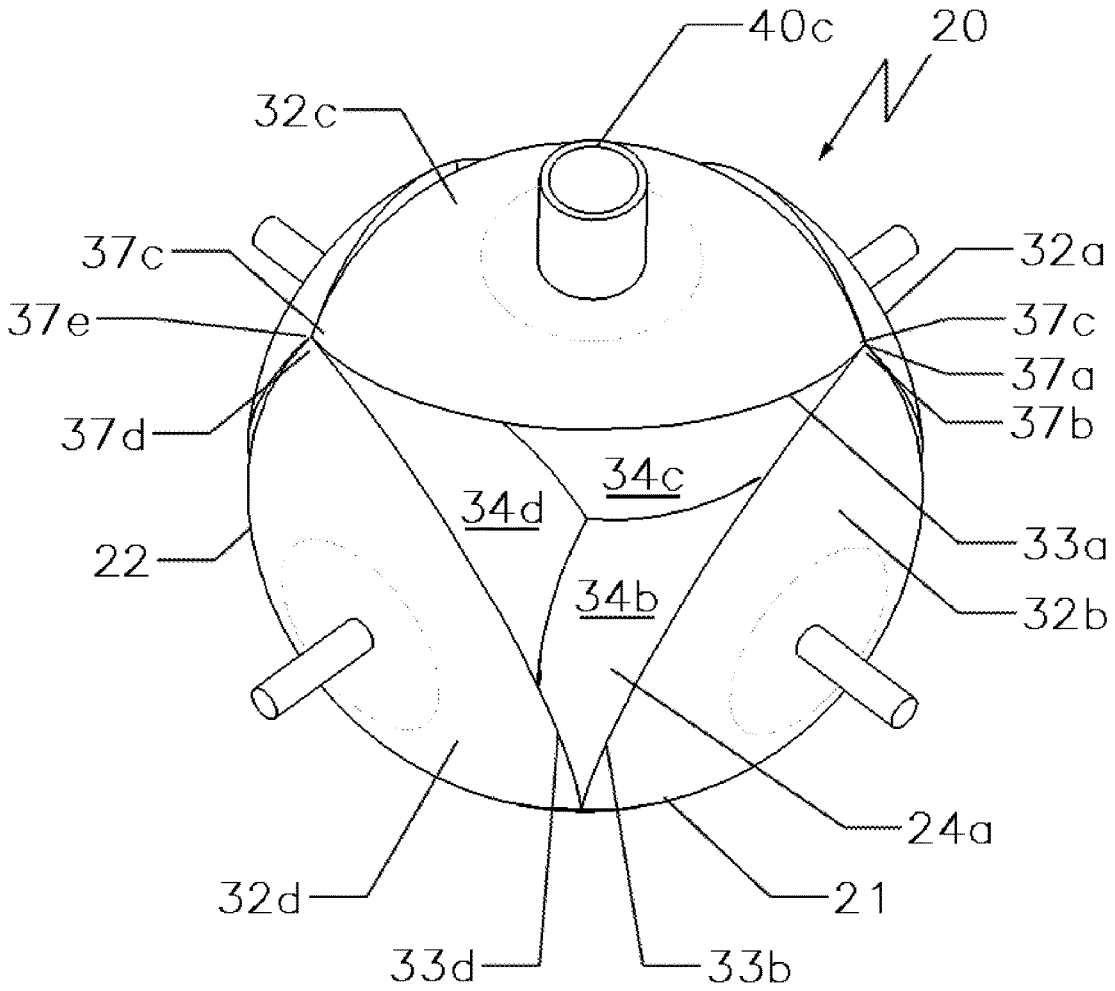
FIG. 12 is a schematic illustration of the rotor mechanism of FIG. 11.

The rotor units 30 are solid elements in the form of a conical spiral arranged on an axis 31. The rotor units 30 are positioned such that the axis 31*a*-31*f* of each rotor unit 30 is at right angles to the axis 31*a*-31*f* of the adjacent rotor units. Each rotor unit 30 is arranged so as to cooperate with one another such that the petal shaped outer surface 32 of each rotor unit 30 is curved concavely out from the rotor mechanism 20 and contributes to the outer surface 22 of the rotor mechanism body 21. This is best seen in FIG. 12. The petal shape outer surface 32 of each rotor unit 30 is defined by an outer edge 33. Each rotor unit 30 is further provided with lateral surfaces 34 and 36, in this case lateral surfaces 34*b*, 34*c* and 34*d* can be seen between the outer edges 33*b*, 33*c* and 33*d* wherein the lateral surfaces 34*b*, 34*c* and 34*d* cooperate for form an outer surface recess 24*a* which may be considered as a temporary port. It can also be seen that for rotor units 30*b*, 30*a* and 30*c*, rotor tips 37*a*, 37*b* and 37*c* of outer surfaces 32*a*, 32*b* and 32*c* all meet, thus closing the outer surface 22 at these points, which may be considered as closed points. This is also the case at the rotor tips 37*c*, 37*d* and 37*e* and so on around the rotor mechanism 20. For the six rotor units 30, there will be four outer surface recesses 24, or temporary ports, and four closed points at a time. In addition, it can be seen that between these closed points formed by rotor tips 37*a, b* and *c*, and so on, a chamber is formed 42 which is closed to both the central cavity 26 of the rotor mechanism 20 and the outside environment 28 surrounding the rotor mechanism 20. This is best seen in FIG. 11.

Figure 13:
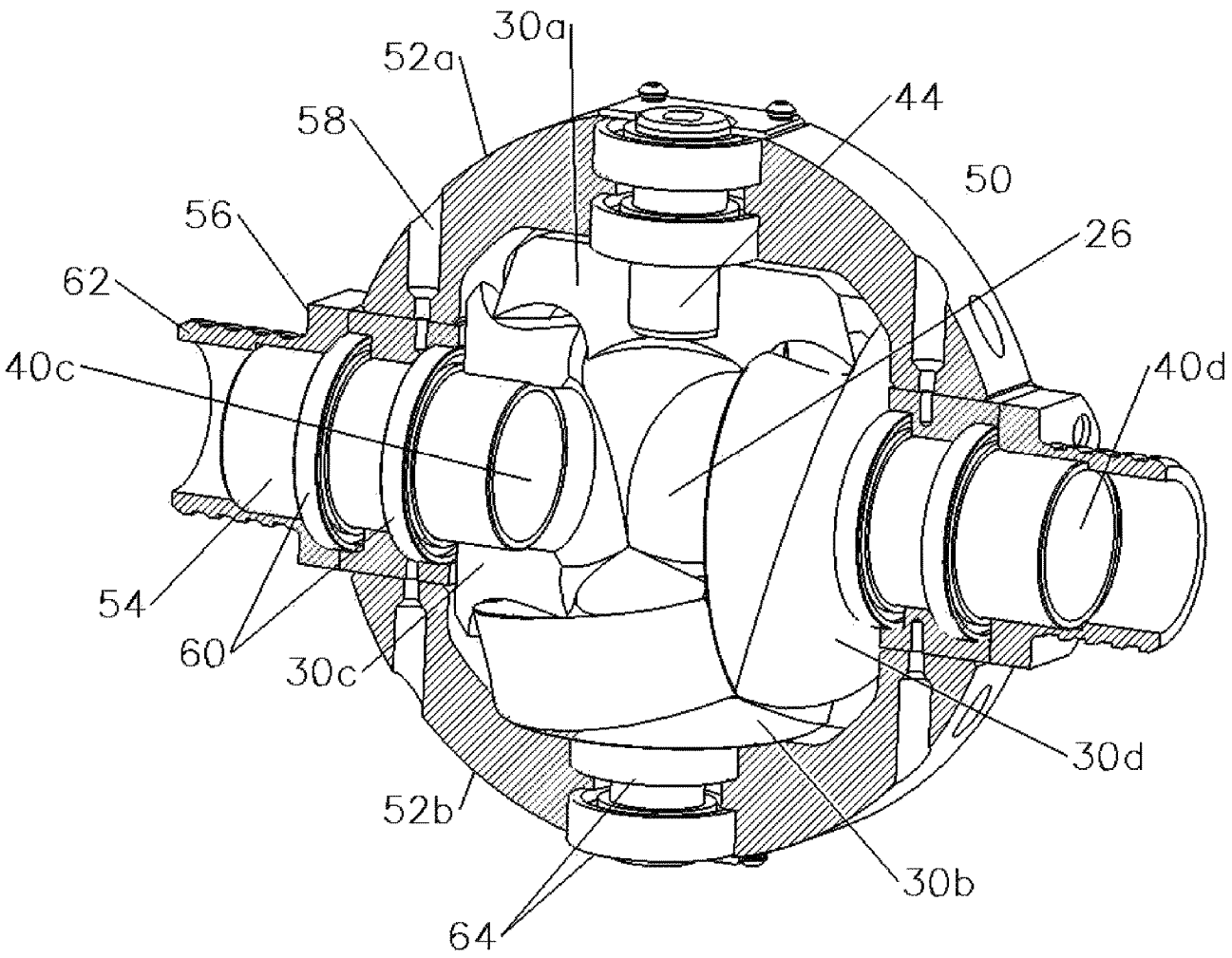
FIG. 13 is a schematic illustration of a frame arrangement of a rotor mechanism according to an embodiment of the present invention.

Without an internal gearing structure 7, as in the prior art, the rotor units 30 are held together by use of a frame 50, illustrated in FIG. 13. In FIG. 13, like parts to those of FIGS. 11 and 12 have been given the same reference numerals to aid clarity. Frame 50 comprises four arc sections 52*a*-*d*. Only two 52*a,b* are shown, but 52*c,d* would be arranged to form a circle which would lie perpendicularly to arc sections 52*a,b* to provide a spherical cage as the frame 50. At the port 40*c*, and for this illustration the opposite rotor unit 30*d* also has a port 40*d* connecting to the central cavity 26, a tubular section 54 is inserted into the port 40 to extend the port 40 out of the frame 50. Between the arc sections 52 and the tubular section 54 is a bearing unit 56. Each port 40 has a tubular section 54 and a bearing unit 56. Each bearing unit 56 connects to the four arc sections 52 at screw threads 58. Each bearing unit 56 houses two bearing rings 60 arranged along the tubular section 54, so that the tubular section 54 and with it the rotor unit 30*c* can rotate independently of the frame 50. The bearing unit 56 also provides an exit port 62, for connection to a pipe or tubing as required.

On the rotor units 30 which do not include ports 40, a bearing axle 44 is fixed into the outer surface 32 of the rotor unit 30. The axle 44 does not extend through the rotor unit 30 and is only embedded sufficiently to turn with the rotor unit 30. Preferentially ports 40 face each other, when more than one is present. In this embodiment two are shown, but there may be up to six in i.e. one per rotor unit 30, if desired. Each arc section 52 has a twin set of bearing rings 64 arranged centrally and axially on the arc. The bearing rings 64 slide over the axles 44 and allow the axles 44 together with their attached rotor unit 30 to rotate independently of the frame 50.

By using pairs of bearing rings 60,64 at each of the six axes 31 of the rotor mechanism 20, the axes are cantilevered for support.

Each of the rotor units 30 is now considered in greater detail with FIGS. 14A to 14 F illustrating a variety of perspective and plan views of a rotor unit 30.

With reference first to FIG. 14A, there is shown a plan view of a rotor unit 30 in which can be seen inner surface 38 which has a petal shape. The inner surface 38 is located between first lateral surface 34 and second lateral surface 36.

As can be seen from FIG. 14B in which a side view of rotor 30 is shown, lateral surface 34 has a tapering helical form with lateral surface having an opposing tapering helical form such that together lateral surface 34 and 36 form a truncated double helix. The form of the rotor unit can be understood as being a conical screw which is twisted at an angle $\phi$ over length L of a truncated cone. Inner surface 38 is curved concavely into the body of the rotor unit 30 and outer surface 32 curves concavely away from the body of the rotor unit 30. Axle 44 is located in the centre of outer surface 32. Note than the axle 44 is a protrusion which does not pass through the rotor 30.

With reference to FIG. 14C there is shown a plan view of a rotor unit 30 with section lines A-A; B-B and C-C detailed. As can be seen the outer edge 33 defines outer surface 32 and lateral surfaces 34 and 36 having driving edges 34' and 36' which extend slightly beyond outer edge 33 at diametrically opposite positions on the outer edge 33. In FIGS. 14D, 14E and 14F cross sectional views of the rotor unit 30 are shown through section lines A-A, B-B and C-C respectively.

In use, the six rotor units 30 are located within the frame 50. In an embodiment of a submersible or bilge pump, a single port 40 is present and the connection 62 will be made to tubing to be routed overboard. On one axle 44, there will be located a DC motor to turn the axle into a drive shaft and cause rotation of the rotor unit 30 to which the axle 44 is affixed. A low rpm is all that is required as the motor is only turning the single rotor unit. The rotor mechanism body 21 in it's frame 50 is submerged in water.

The rotation of a single rotor unit 30 by the motor impels the other rotor units to turn synchronously about their axis 31. With reference now to FIGS. 15A to 15D there is shown two rotor units combined to better illustrate the interlinking of rotor units 30 in rotor mechanism 20 and the progression of the driving mechanism which results from the cooperation of the rotor units. As can be seen in FIG. 15A, rotor unit 30*a* is arranged so that it is cooperating with, and at right angles to rotor unit 30*b*. Inner surface points 39*a* and 39*b* are arranged so as to be touching one another and driving edge 34'*a* of lateral surface 34*a* is arrange so that upon rotation, it will act upon lateral surface 36*b* by imparting a force. The incident angle between the driving edge 34'*a* and driven surface, in this case lateral surface 36*b* contributes, along with other factors such as the distance from the extremity of contact to the central axis of the driving edge, to determining the torque required to drive the rotors units 30 of the rotor mechanism 20.

It will be appreciated that when three or more rotor units 30 are interlinked perpendicular to one another the driving functionality of the arrangement will act continuously with a driving edge 34' acting on one rotor unit 30 for a 180° turn after which it will act on another adjacent rotor unit 30. As there are two driving edges 34', 36' per rotor unit 30 a continuous driving process through a rotation of 360° is achieved.

The interlocking helical form of rotor units 30*a-f*, when arranged to form the rotor mechanism 20 of FIGS. 11 to 13 are such that when a driving force is applied to one rotor, for example, rotor 30*a*, the form of the driving rotor unit 30*a* as described with reference to FIGS. 14A to 14F will act upon adjacent rotor units 30*b*, 30*c*, 30*e* and 30*f* (not shown) imparting a force which will cause these driven rotor units 30*b*, 30*c*, 30*e* and 30*f* to rotate on an axis at 90° to the driving rotor 30*a*. Each of these rotor units 30*b*, 30*c*, 30*e* and 30*f* will impart a force to drive the sixth rotor unit 30*d* in the same manner as described for the other rotor units.

Referring back to FIG. 12, we can consider this as a start position. There will be four recesses 24 exposed on the spherical body 21. Equally there will be four closed points where three rotor tips meet. In this configuration, behind each closed point there is a closed chamber 42 formed from the lateral surfaces of the rotor units 30. As the rotor units 30 begin to rotate, the closed point is opened, thereby drawing fluid in which the rotor mechanism 20 is immersed, into the body 21. A contrasting motion occurs at the recesses 24. Each rotor tip travels along the edge 33 of another rotor unit 30 so that each closed point becomes a recess 24 in a 180 degrees rotation of the rotor units. As the driving and driven rotors 30*a-f* rotate, the interlocking edges 33, 34', 36' and surfaces 34, 36 temporally create closed chambers 42 which capture fluid, either from the external environment 28 or the central cavity 26, propelling it in to, or out of the mechanism 20 depending on the direction of rotation of the rotor units 30. Following 360 degrees rotation of the rotor units 30, the body 21 will have returned to the start position. The progression of fluid is illustrated in FIGS. 16A-F which shows the creation of the recesses 24, movement of fluid into a closed chamber 42 and the movement of fluid into the free space central cavity 26. Four paths are shown in FIG. 16A-F, but a further four paths will exist on the cross-axis of the body 21. For our bilge pump water is drawn in from the outer surface 22 into the free space cavity 26 and out of the exhaust port 40.

If each of the rotor units 30 are formed in such a manner that the spiral edge of each rotor unit 30 provides a coil at equal to 180 degrees at the closed point, then the internal cavity 42 is completely isolated from the environment 28. Such a design is referred to as 'not blown', which provides for the possibility of pumping at high pressure. This is in contrast to known designs of turbine and centrifugal pumps in braked conditions which are blown or have permeability. Preferentially, the radii of the central cavity 26 and body 21 is selected together with the length of rotor, angle of rotation and volume of outlet to provide near constant volume of fluid through the rotor mechanism so that back pressure is avoided. In particular, the radius of the central cavity 26 is made greater than half the radius body 21. This also reduces the pressure differential through the rotor mechanism so that the fluid is never compressed and prevents damage to the rotor units.

Figure 17A:
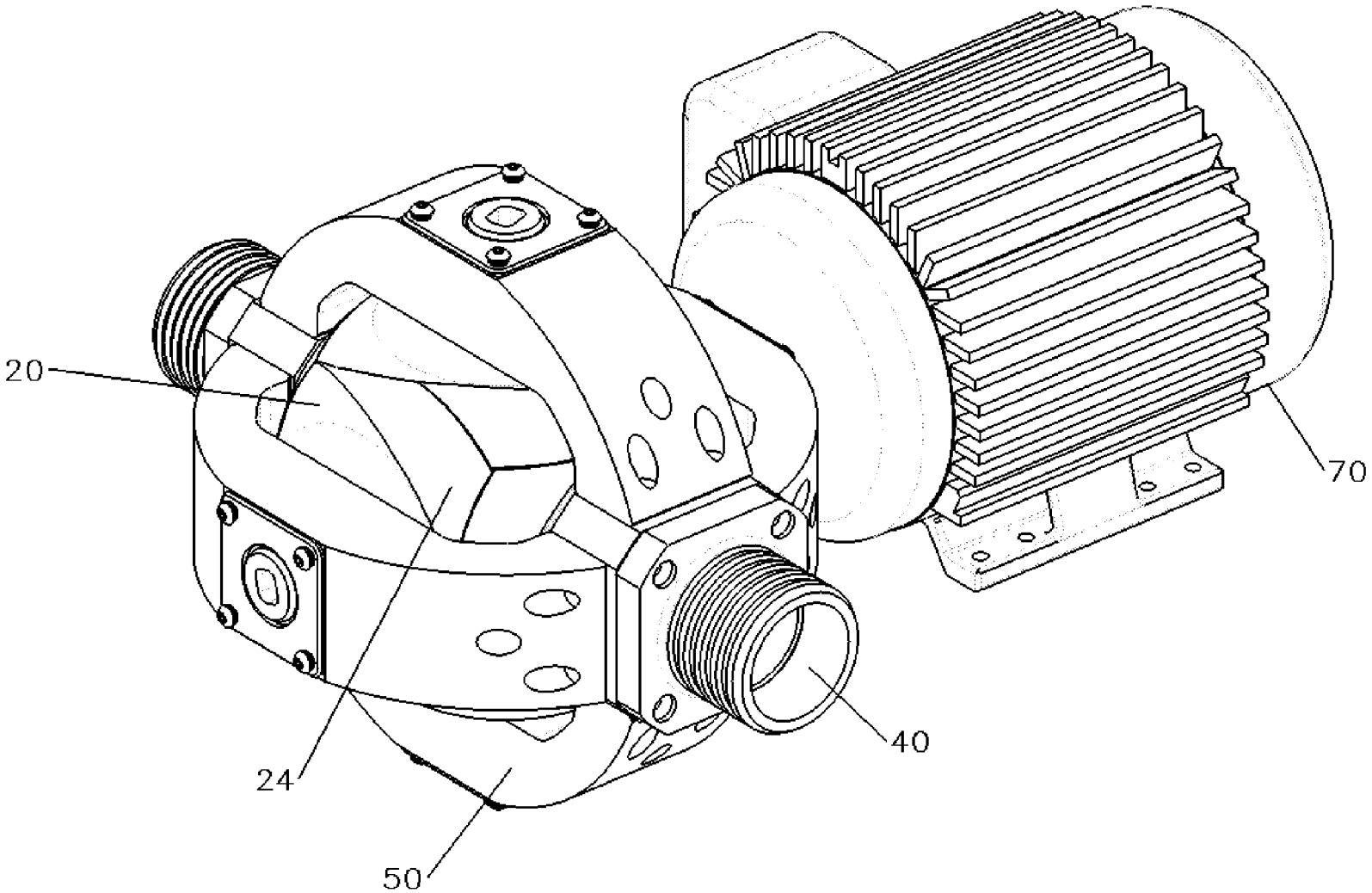
FIGS. 17A and 17B are schematic illustration of pumps according to embodiments of the present invention.
Figure 17B:
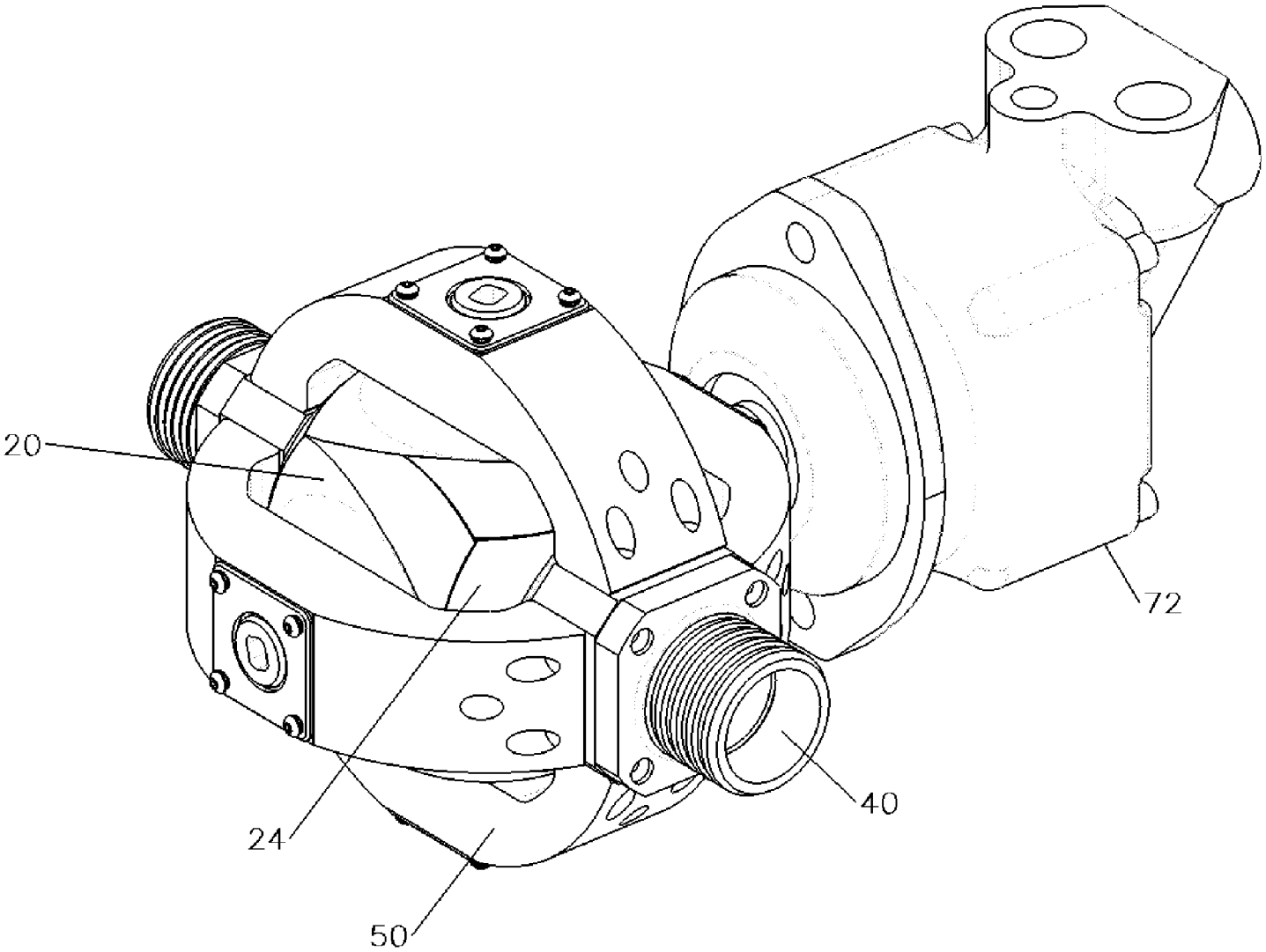

As detailed above with reference to a submersible or bilge pump, the rotor mechanism 20 can be driven by any external motor. FIG. 17A illustrates the rotor mechanism 20 within the frame 50 being driven by an electric motor 70. The drive shaft of the motor 70 is connected to an axle 44 on one of the rotor units 30. Operating the motor 70, will turn the rotor unit 30 at the drave shaft, this in turn will compel the other rotor units to turn as described hereinbefore. If the frame 50 is immersed in fluid, the fluid will be drawn into the rotor unit unit and be expelled through the ports 40. In this arrangement two ports 40 are shown, but up to five exit ports could be provided. If the drive is reversed, fluid can be drawn in at the ports 40, and expelled through the temporary ports 24. Alternative drive arrangements can be used such as a diesel engine, petrol engine (2 stroke/4 stroke) Wankel engine, steam, wind turbine and a reciprocal engine. A hydraulic motor 72 is illustrated in FIG. 17B. Those skilled in the art will recognize that any external motor system can be used to drive the rotor mechanism 20.

Figure 18:
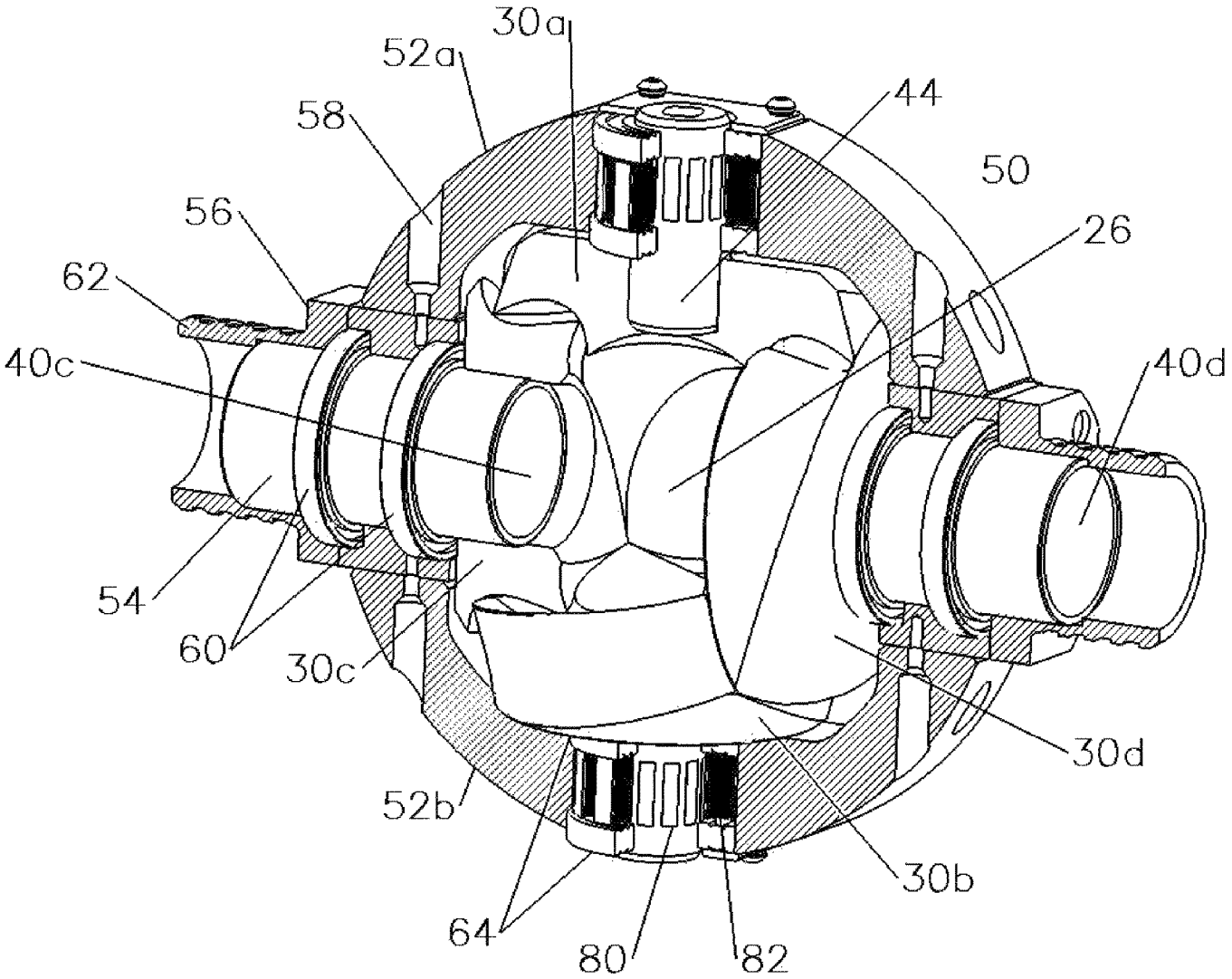
FIG. 18 is a schematic illustration of a rotor mechanism arranged for a motor or turbine according to an embodiment of the present invention.

Further embodiments of the present invention are provided by incorporating a magnet and coil arrangement at the axes 44. An example of this embodiment is shown in FIG. 18. In this arrangement the axle 44 includes a circumferentially arranged set of magnets 80. Around each axle 44, at the location of the magnets 80, is a set of winding coils 82. Equally, the magnets could be arranged around the coil.

By applying an electric current to the windings 82, a magnetic field is generated which imparts a rotational force on the accompanying rotor unit 30. The corollary is also useful, in that if the rotors 30 are moved by any means of propulsion, the magnets 80 will rotate and the coils 82 will move through the magnetic fields of the magnets 80, establishing a current in the windings and thus creating electricity.

The principle advantage of the present invention is that it provides a rotor mechanism which does not require an enclosed waterproof housing.

A further advantage of the present invention is that it provides a rotor mechanism which does not compress the fluid as it moves through the mechanism.

A yet further advantage of the present invention is that it provides a pump achievable at very low values of RPM.

Further advantages of the present invention are realized in that it has a high compactness of design (low weight and small dimensions); low number of elements to give a simplicity in design and construction; low level noise; low level of vibration; constancy of stream of a pumped over product; small friction losses and small power consumption compared with pumps of similar productivity.

Modifications may be made to the invention herein described without departing from the scope thereof.

The invention claimed is:

1. A rotor mechanism for use in moving fluid, the rotor mechanism comprising:

a plurality of rotor units spherically arranged to form a rotor mechanism body; each rotor unit including an outer surface and an inner surface and at least one rotor unit having a first opening on the outer surface and a second opening on the inner surface such that an elongate aperture extends between the first and second openings to create a port through the rotor unit;

wherein the rotor mechanism body is supported by an external frame comprising a plurality of apertures which allow fluid to flow therethrough and contact an outer surface of the rotor mechanism body; and wherein rotation of at least one rotor unit causes rotation of adjacent rotor units which thereby moves fluid without compression between the outer surface of the rotor mechanism body and the port via a central substantially spherical uninterrupted free space cavity formed by the cooperation of the inner surfaces of the rotor units.

2. A rotor mechanism according to claim 1 wherein the external frame comprises a plurality of arcs.

3. A rotor mechanism according to claim 1 wherein the external frame supports the rotor mechanism body on a plurality of bearings.

4. A rotor mechanism according to claim 1 wherein at least two rotor units have a port through the rotor unit.

5. A rotor mechanism according to claim 1 wherein each rotor unit is operable to co-operate with adjacent rotor units such that during rotation plural channels are created in which fluid is carried in one direction between the outer surface of the rotor mechanism body and the central substantially spherical uninterrupted free space cavity.

6. A rotor mechanism according to claim 5 wherein each rotation fills each one of the plural channels and seals each end thereof to create a temporary chamber.

7. A rotor mechanism according to claim 1 wherein each rotor unit has at least two lateral surfaces which are arranged to provide the rotor unit with a truncated double helix form.

8. A rotor mechanism according to claim 1 wherein the rotor mechanism is provided with six rotor units, the rotor units having the same dimensions.

9. A rotor mechanism according to claim 8 wherein each rotor unit comprises a conical screw rotor, having an axis at right angles to adjacent rotor units and which is twisted at an angle over a length of a truncated cone.

10. A rotor mechanism according to claim 9 wherein a radius of the central substantially spherical uninterrupted free space cavity is greater than half the radius of the rotor mechanism body.

11. A rotor mechanism according to claim 10 wherein the rotor units have dimensions such that the rotor mechanism pumps up to around half the volume of the rotor mechanism body on a single rotation of the rotor units.

12. A rotor mechanism according to claim 11 wherein the radius of the rotor mechanism body, the length and twist angle of the rotor units and dimension of the port are selected to substantially equalize the volume of fluid travelling through the rotor mechanism.

13. A rotor mechanism according to claim 1 wherein a spiral edge of each rotor unit making up the central substantially spherical uninterrupted free space cavity, has a coil of just equal to 180 degrees in order to completely isolate the central substantially spherical uninterrupted free space cavity from the environment.

14. A rotor mechanism according to claim 1 wherein in use, a first rotor unit is held stationary and the remaining rotor units rotate synchronously around three mutually perpendicular axis which converge at a central point of the central substantially spherical uninterrupted free space cavity of the rotor mechanism.

15. A rotor mechanism according to claim 1, the rotor mechanism further comprising a drive unit which in use, acts upon one of said rotor units operable to rotate in order to actuate and drive the rotatable rotor units.

16. A rotor mechanism according to claim 1, the rotor mechanism further comprising a drive unit which operates in the rotor mechanism by means of an electromagnetically induced rotation.

17. A rotor mechanism according to claim 16 wherein one or more rotor units include windings coupled with a magnetic source of opposing pole, and an induced rotational force is delivered by electrical supply to the windings.

18. A rotor mechanism according to claim 1, wherein one or more rotor units include windings coupled with a magnetic source of opposing pole and wherein rotation of the rotor units is carried out by an external force and electricity is generated by moving the windings across the magnetic field.

19. A rotor mechanism according to claim 1 wherein the application of a fluid through the port induces rotation of at least one rotor unit which thereby operates the rotor mechanism.

* * * * *